US006644520B2

(12) United States Patent
Lam

(10) Patent No.: US 6,644,520 B2
(45) Date of Patent: Nov. 11, 2003

(54) ADJUSTABLE GARMENT HANGER

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 0 days.

(21) Appl. No.: 10/041,434

(22) Filed: Jan. 8, 2002

(65) Prior Publication Data

US 2002/0056735 A1 May 16, 2002

Related U.S. Application Data

(63) Continuation-in-part of application No. 09/699,071, filed on Oct. 26, 2000, now Pat. No. 6,409,058.

(51) Int. Cl.[7] ..... A41D 27/22
(52) U.S. Cl. ..... 223/94; 223/85; 223/89
(58) Field of Search ..... 223/94, 89, 85

(56) References Cited

U.S. PATENT DOCUMENTS 6,409,058 B1 * 6/2002 Lam et al. ..... 223/94

* cited by examiner

*Primary Examiner*—John J. Calvert
*Assistant Examiner*—James G Smith

(57) ABSTRACT

An adjustable garment hanger (100) is disclosed having movable arms (103, 107) which move laterally from a medial portion (105). The movable arms move as a result of engagement between a pair of linkage tongues (104, 106) and a medially positioned adjustment mechanism. The linkage tongues are positioned inside a U shaped guiding channel (113) positioned parallel to a pair of supporting arms extending from the medial portion of the garment hanger.

21 Claims, 4 Drawing Sheets

ADJUSTABLE GARMENT HANGER

This is a Continuation In Part of U.S. patent application Ser. No. 09/699,071 filed Oct. 26, 2000, now U.S. Pat. No. 6,409,058. Garments are optimally displayed and maintained on hangers sized appropriately to the garment. A garment manufacturer or retailer can achieve this either by using differently sized fixed width hangers or by using adjustable width hangers. Similarly, an end user could adopt a particularly sized fixed width hanger or selectively adjust an adjustable width hanger to his garment size.

FIELD OF THE INVENTION

The present invention relates to garment hangers.

BACKGROUND OF INVENTION

The prior art is replete with various configurations of garment hangers that incorporate structure for selectively adjusting the hanger's width to accommodate different size garments. Applicant's issued U.S. Pat. Nos. 5,102,019; 5,511,701, 5,664,710 and pending U.S. patent application Ser. No. 09/699,071 disclose some such structures as do certain ones of the references U.S. Pat. Nos. 2,477,873, 3,024,954, 5,044,535, European patents DE-C-286 192, WO-A-94 02056, DE-U-88 04 572 and DE-A-40 07 320 cited therein.

SUMMARY OF THE INVENTION

The present invention is directed to garment hangers incorporating improved structures for adjusting the hanger's width to support garments of different sizes.

According to one aspect of the present invention there is provided an adjustable garment hanger having first and second elongated support arms extending from a medial portion, a transfer mechanism located at the medial portion; and first and second movable arms mounted respectively for translation along the first and second support arms. The first and second support arms are supported relative to one another at an obtuse angle therebetween; and in that each of the movable arms couples to the transfer mechanism by a linkage tongue for reciprocal translation of the movable arms along their respective support arms. When force is applied on the first movable arm in the direction along the axis of the respective first support arm, the force is translated to the second extension arm for reciprocal motion of the second extension arm along the second support arm. The transfer mechanism incorporated in this embodiment is at least one wheel and in that each of the linkage tongues is coupled to the wheel for reciprocal translation of the movable arms along their respective support arms. Each of the linkage tongues is preferred to comprise a flexible section, located at the region proximate to the medial portion of the hanger.

In another alternative embodiment, an adjustment knob is integrally molded or coupled to the wheel to facilitate manual turning thereof for translation of the movable arms. Conveniently, an electric motor is provided for driving the wheel.

In yet a further embodiment a transfer mechanism preferably comprising at least a first wheel mounted proximal to the medial portion for rotation; each of the linkage tongues having an inner end and an outer end. The inner ends of each linkage tongue is coupled to the transfer mechanism for reciprocal translation of the movable arms along their support arms. Advantageously, in any of the embodiments the wheel(s) includes a plurality of peripherally defined teeth and each inner end of the linkage tongues defines a plurality of teeth. Although the linkage tongue is preferably to be of a rigid structure for this embodiment, it can also comprise a flexible region to interact with the adjustment or transfer mechanism.

According to another aspect of the present invention there is provided a method of forming an adjustable garment hanger, comprising the steps of arranging first and second elongate support arms to define an obtuse angle therebetween; providing an adjustment or transfer mechanism at the medial portion of the hanger; mounting open ended first and second linkage tongues on the first and second arms respectively for translation therealong; and for reciprocal translation of the linkage tongues along their respective support arms; mounting first and second movable arms to travel along the respective supporting arms; and connect each linkage tongues with the respective movable arms.

In yet another embodiment, the medial portion is divided into two halves; a front half and a rear half. The two supporting arms extend from each end of either the front half or the rear half of the medial portion, and these sections are formed as an integral part by injection molding or die-casting. The other half forms a cover to cover the medial portion only. In this embodiment, after the open-ended linkage tongues are installed in the first half of the hanger, the other half is covered onto the assembly to prevent the components from detached. In this design, each of the supporting arms is formed in a U shape channel to accommodate the linkage tongues of the two movable arms. Since the U shape channels are not covered, there is an opportunity for the remote ends of the linkage tongues to expose from the open sides of the U shape channels.

In a further preferred embodiment channels are provided for guiding each of the linkage tongues along a path that feed the linkage tongue to the adjustment or transfer mechanism located at the medial portion of the garment hanger. Conveniently, each of the channel or paths includes a first segment substantially aligned with one of the support arms and a second segment substantially aligned with the other of the support arms. The channels, or guides, preferable be able to guide the flexible linkage tongue along the respective supporting arm, have guiding walls surrounding the linkage tongue so as to maintain the flexible region of the linkage tongue to stay in a proper shape under control. In case of a U shape supporting arm design, a retaining structure is required to prevent the flexible linkage tongue from exiting the supporting arms through the open side of the U shape channel. One of the retaining design is to provide a guiding tongue or rib along the side of the first flexible linkage tongue and a matching groove along the side of the other flexible linkage tongue, such that the tongue and groove engage the two flexible linkage tongues together and prevent them from exiting the open side of the U shape supporting arm.

The gear of the upper linkage tongue is preferred to face upward and that of the lower linkage tongue to face downward, such that the matching tongue and groove design can be provided to the lower side of the upper linkage tongue and the upper side of the lower linkage tongue. Unlike applicant's previously invented adjustable hangers, the two flexible linkage tongues are touching and sliding along each other during the hanger width adjusting process. It means the tongue and groove of the two flexible linkage tongues are configured to slide against each other; accordingly it is difficult for the transfer mechanism to provide a gear in between the two linkage tongues. In a preferred embodiment, the transfer mechanism provides a first gear on top of the upper linkage tongue, a second gear beneath the lower linkage tongue. A third gear is positioned by the side of the sliding linkage tongues, engaging the first and second gears to provide the reciprocal transfer motion. Alternately an O ring with internal gears is provided for linking the first gear to the second gear to provide the reciprocal transfer motion.

In order to prevent the movable arms and the linkage tongues to be removed from the garment hanger when the movable arms are stretched to the outermost position, stoppers interacting between the linkage tongues and the guiding walls or a stopping structure at the medial portion are provided. Alternatively, interacting stopper can be provided in between the support arms and the moving arms as disclosed in applicant's issued U.S. Pat. No. 5,727,718. Many different stopper designs known to the art can be implemented to restrict the movement of the linkage tongues or the movable arms when they are extended to a predefined extended position.

DESCRIPTION OF THE PREFERRED EMBODIMENTS

Figure 1:
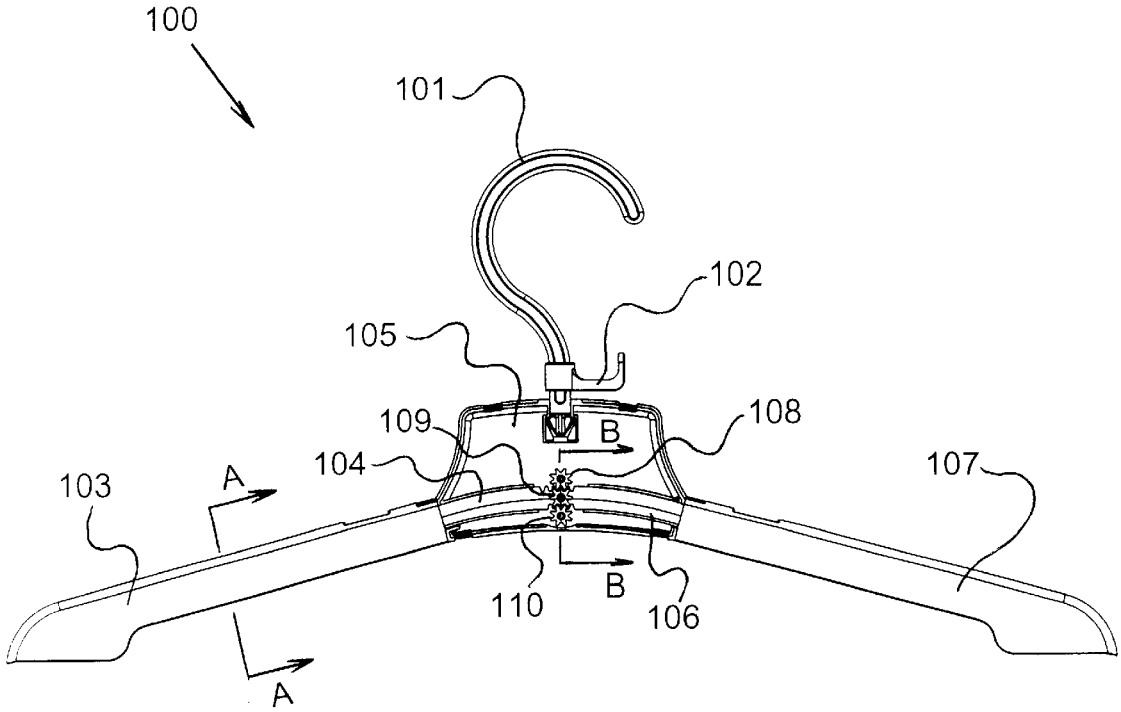
FIG. 1 is a see through view of an adjustable garment hanger showing a preferred embodiment in accordance with the present invention.

FIG. 1 is a see through front view illustrating a preferred adjustable hanger embodiment 100 in accordance with the present invention. The hanger 100 includes a medial portion 105 connected to a pair of elongate supporting members and a suspension member 101 in the shape of a hook. The supporting arms arranged to define an obtuse angle from the medial portion 105. On top of each supporting arms are the movable arms 103 and 107 that reciprocally slide along the supporting arms extended from the medial portion. The movable arm 107 is connected to a flexible linkage tongue 110. Another flexible linkage tongue 104 extends from the inner end of the movable arm 103. Each of the flexible linkage tongues are provided with a plurality of teeth (partially shown in FIG. 1) for engaging to the transfer mechanism. The proximal regions of the linkage tongues 104 and 106 are guided to engage an adjustment or transfer mechanism. In a preferred embodiment this adjustment mechanism is represented by one or more wheels rotatably mounted at the medial portion 105 of the garment hanger frame. The transfer mechanism may be connected to an adjustable knob 103 for adjusting the width of the hanger. The flexible proximal regions of the linkage tongue follow respective guide paths or channels that are tangent to the transfer mechanism. These guiding channels are substantially parallel to the supporting arms.

Thus, each linkage tongues 104, 106; and therefore the movable arms 103, 107 can be reciprocally translated along its respective supporting arm according to the function of the transfer mechanism. Movement of the linkage tongues 104, 106, and the respective movable arms they connected can be accomplished by holding each movable arm in one hand and urging them inward or outward. Alternatively, the garment hanger can be held in one hand and either one of the movable arms urged inward or outward with the other hand. Engagement of the flexible region 104 with the transfer mechanism insures that any change in the spacing of one linkage tongue or movable arm from the medial portion is accompanied by an equal change in the spacing of the other linkage tongue 106 and movable arm 107, i.e., the linkage tongues 104, 106 are reciprocally and oppositely translated on their respective supporting arms. In another preferred embodiment, an adjustment knob is coupled to the transfer mechanism allows the user to adjust the width of the hanger while a garment is supported on the hanger.

A characteristic of the adjustable garment hanger of FIG. 1 when compared with the prior art is that the two linkage tongues are sliding directly against each other. The transfer mechanism is coupled to the top side of the upper linkage tongue and the bottom side of the lower linkage tongue. In a preferred embodiment, on top of the upper linkage tongue 104 is a first wheel or gear 108. Beneath the lower linkage tongue 106 is a second wheel or gear 110. A third gear 109 engages in between the first gear 108 and the second gear 110 to form a reciprocal transfer mechanism.

A hanger 100 is, therefore, provided which can be quickly and easily adjusted to a lateral spacing between movable arms that most effectively supports a chosen garment. The movable arms are simply urged inward or outward by hand or an adjustment knob as necessary to best fit and support the garment and they remain in the desired spacing until readjusted for another garment. The hanger can be fabricated with an obtuse angle, between the movable arms 103, 107, that best accommodates and supports a chosen garment type, e.g., coats.

Figure 2A:
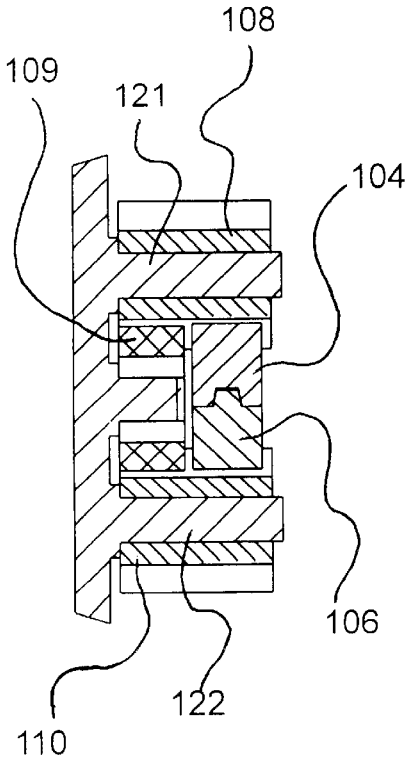
FIG. 2A is an enlarged sectional view to illustrate the assembly of an embodiment of a transfer mechanism.
Figure 2B:
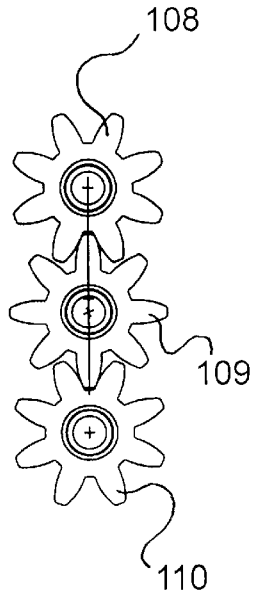
FIGS. 2B and 2C are front and rear views to illustrate the assembly of the transfer mechanism of FIG. 2A.
Figure 2C:
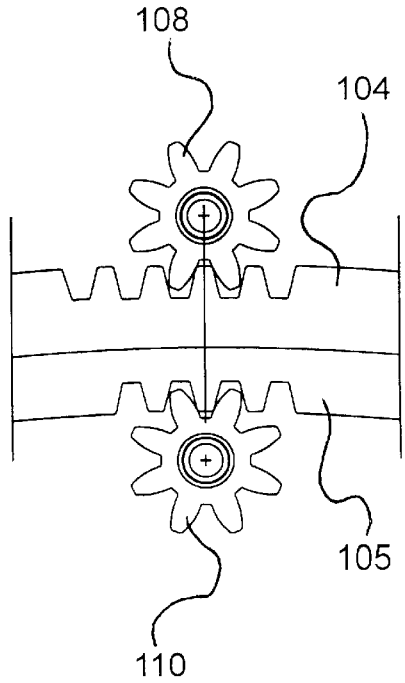

Directing attention now to a more detailed disclosure of the preferred embodiment relative to FIG. 2A, a view showing the section B—B of FIG. 1. It is seen that upper first gear 108 is coupled to the upper teeth rack of the upper linkage tongue 104; the second gear 110 is coupled to the bottom side of the lower linkage tongue 106 as illustrated in FIG. 2C. A third gear 109, positioned by the side of the two sliding linkage tongues 104 and 106, linked the first gear 108 to the second gear 110 to provide the reciprocal transfer motion as shown in FIG. 2B.

Figure 3:
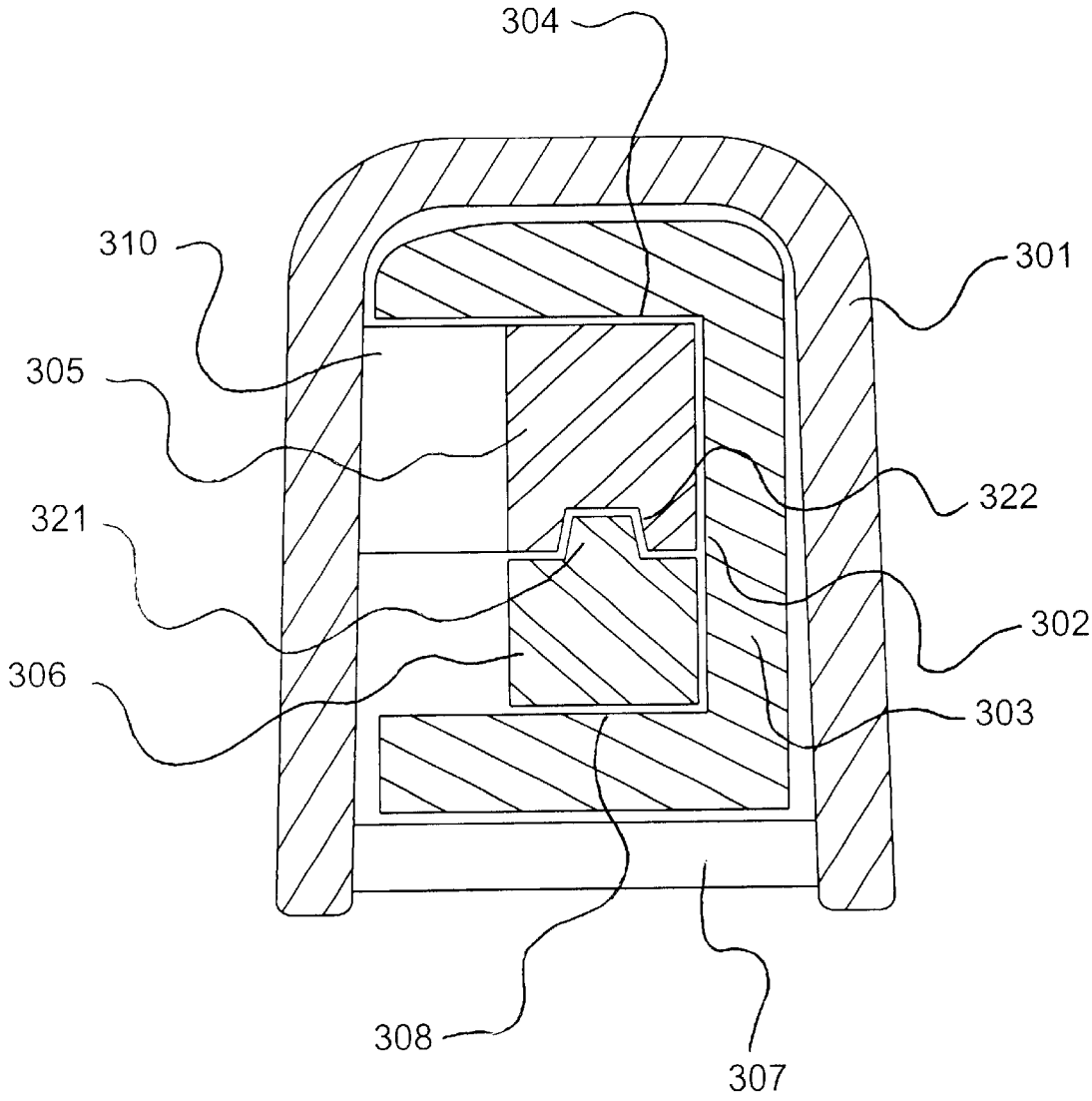
FIG. 3 is the sectional view to illustrate the tongue and groove design to keep the two flexible linkage tongues to stay inside the channels of the U shape supporting arms.

FIG. 3 illustrates the sectional view A—A of the supporting arm and movable arm. The outer portion 301 of the sectional view represents the movable arm which is adjusted against the inner supporting arm 303. In order to save manufacturing cost, the supporting arm 303 is formed as a single piece structure as compared with a two halves structure illustrated by the prior art. In a preferred embodiment, the supporting arm 303 is structured to provide a upper wall 304, a lower wall 308 and a side wall 302. On the other side of the side wall 302 is an open space 310 to facilitate the injection process that forms the supporting arm 303. In side the channel of the supporting arm 303 are the first linkage tongue 305 and the second linkage tongue 306 that are in direct contact and slide against each other. The channel formed by the three walls 304, 302 and 308 governs the movement of the two linkage tongues. In order to prevent the linkage tongues from leaving the guiding channel through the open space 310, the upper linkage tongue 305 is coupled to the lower linkage tongue 306 with a guiding tongue 321 and glove 322 design.

Figure 4:
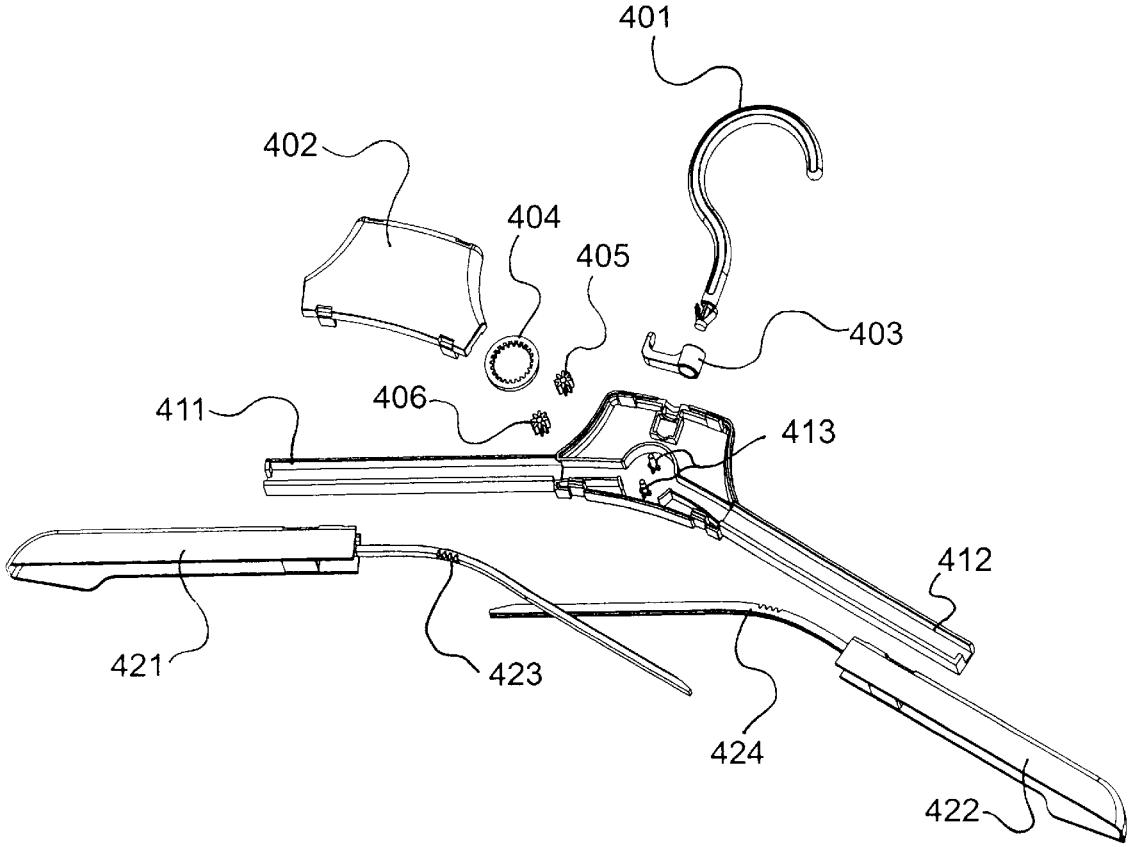
FIG. 4 illustrates an exploded view of an alternate embodiment using an O ring with internal gears to replace the third gear of FIG. 2B for engaging the first and second gears of the transfer mechanism.

FIG. 4 illustrates the exploded view of an alternate preferred embodiment. The difference of this embodiment as compared with that of the first preferred embodiment of FIG. 1 is that the third engagement gear 109 of FIG. 1 is replaced by an O ring shaped gear 404. The internal gear of the O ring linked the first gear 405 to the second gear 406. All other designs are substantially similar to that of FIG. 1. It can be observed that the linkage tongue 423 extends from the inner end of the movable arm 421. The linkage tongue 424 extends from the inner end of the second movable arm 422. Both supporting arms 412 and 412 provide a U shaped channel to accommodate the linkage tongues 423 and 424 that slide directly against each other. During the assembly process the movable arms 421 and 422 are assembled into the supporting arms 411 and 412, with the tongue and groove of the two linkage tongues 423 and 424 engaged. The upper surface of the linkage tongue 424 and the lower surface of the linkage tongue 423 define a plurality of spaced teeth. The gears 405 and 406 are placed onto the upper and lower sides of the linkage tongues, and rotate at the shafts 413. The third gear 109 as illustrated in FIG. 1, or the O shaped gear ring 404 is then assembled to link the first gear 405 to the second gear 406. After placing the suspension member 401 and the second hook 403 into the medial portion, the housing cover 402 is provided to complete the adjustment hanger assembly.

From the foregoing it should now be recognized that embodiments of a low cost adjustable garment hanger have been disclosed herein especially suited for lateral adjustment to enhance the fit between a garment and its supporting hanger.

Apparatus in accordance with the present invention may be quickly adjusted to conform with different garment sizes. Different movable arms can be shaped to conform to different garments, e.g., coats, dresses. It should be understood that although embodiments have been disclosed having pairs of movable arms moving in opposite directions from a medial frame portion, other embodiments may include different configurations based on the similar concept of structure.

What is claimed is:

1. A garment hanger comprising:

a medial portion;

first and second supporting arms extending in opposite directions from said medial portion; each supporting arm having a recess channel extending along the corresponding supporting arm;

first and second movable arms configured to travel along said first and second supporting arms for defining an adjustable garment supporting width; and first and second linkage tongues each having a first end connected to one of said movable arms; said linkage tongues are further positioned in the recess channels along said first and second supporting arms and coupled to a transfer mechanism located proximate to said medial portion for reciprocal adjustment of said movable arms; and each of said first and second linkage tongues having a second end exposed along the open side of one of said recess channels.

2. The garment hanger of claim 1 wherein said first linkage tongue has teeth positioned on a first side of the linkage tongue and a groove positioned along the second side of said first linkage tongue.

3. The garment hanger of claim 2 wherein said second linkage tongue has teeth positioned on a first side of the linkage tongue and a protruded rib positioned along the second side of said linkage tongue; wherein the groove of said first linkage tongue is configured to mate with the rib of said second linkage tongue for said linkage tongues to slide relative to each other.

4. The garment hanger of claim 1 wherein said first linkage tongue has teeth facing upward and said second linkage tongue has teeth facing downward.

5. The garment hanger of claim 4 wherein said first linkage tongue is positioned to slide directly against said second linkage tongue.

6. The garment hanger of claim 4 further comprising a first gear coupled to the teeth of said first linkage tongue and a second gear coupled to the teeth of said second linkage tongue; said garment hanger further comprising at least a third gear coupled in between said first and second gears.

7. The garment hanger of claim 1 wherein the second end of said first linkage tongue extends to a side by side position parallel with said second movable arm when said second movable arm is in it's innermost position.

8. A garment hanger comprising:

a medial portion;

first and second supporting arms extending in opposite directions from said medial portion;

first and second movable arms configured to travel along said first and second supporting arms for defining an adjustable garment supporting width; and first and second linkage tongues each having a first end and a second end;

wherein the first end of each linkage arm is connected to one of said movable arms; said first linkage tongue has teeth facing upward; said second linkage tongue positioned beneath said first linkage tongue has teeth facing downward and said linkage tongues are further coupled to a transfer mechanism located proximate to said medial portion for reciprocal adjustment of said movable arms.

9. The garment hanger of claim 8 wherein each of said supporting arm has a recess channel and said linkage tongues are positioned along and within said recess channels.

10. The garment hanger of 9 wherein; the second ends of said linkage arms are exposed along the open side of said recess channels.

11. The garment hanger of claim 8 wherein one of said linkage tongues has a groove positioned along a side of said linkage tongue, and the other linkage tongue has a protruded rib configured to mate with said groove for the two linkage tongues to slide relative to each other.

12. The garment hanger of claim 8 wherein the second end of said first linkage tongue extends to contact said second movable arm at a side by side position parallel with each other, when said second movable arm is in it's innermost position.

13. A garment hanger comprising:

a medial portion;

first and second supporting arms extending in opposite directions from said medial portion;

first and second movable arms configured to travel along said first and second supporting arms for defining an adjustable garment supporting width; and first and second linkage tongues each having a first end and a second end;

wherein the first end of each linkage arm is connected to one of said movable arms; said first linkage tongue has teeth positioned on a first side of the first linkage tongue and a groove positioned along the second side of said first linkage tongue; said second linkage tongue has teeth positioned on a first side of the second linkage tongue and a protruded rib positioned along the second side of said linkage tongue; wherein the groove of said first linkage tongue is configured to mate with the rib of said second linkage tongue for said linkage tongues to slide relative to each other.

14. The garment hanger of claim 13 wherein one of said linkage tongues has teeth facing upward and the other linkage tongue has teeth facing downward; and said linkage tongues are further coupled to a transfer mechanism located proximate to said medial portion for reciprocal adjustment of said movable arms.

15. The garment hanger of claim 14 wherein said transfer mechanism comprises of a first gear coupled to the teeth of said first linkage tongue; a second gear coupled to the teeth of said second linkage tongue and at least a third gear positioned between said first and second gears.

16. The garment hanger of claim 13 wherein said transfer mechanism is enclosed by a compartment covering both the front and rear sides of said medial portion; and each of said support arms has a open side exposing said linkage tongues.

17. A garment hanger comprising:

a medial portion;

first and second supporting arms extending in opposite directions from said medial portion;

first and second movable arms configured to travel along said first and second supporting arms for defining an adjustable garment supporting width; and first and second linkage tongues each having a first end and a second end;

wherein said first and second linkage tongues are configured to slide against each other and said linkage tongues comprise mating guiding means to prevent said first linkage tongue to displace from said second linkage tongue when they slide against each other.

18. The garment hanger of claim 17 wherein said first linkage tongue has a groove positioned along a first side of said first linkage tongue; said second linkage tongue has a protruded rib positioned on the first side of said second linkage tongue; and the groove of said first linkage tongue is configured to mate with said protruded rib for said linkage tongues to slide along relative to each other.

19. The garment hanger of claim 17 wherein the second end of said first linkage tongue extends to a side by side position parallel with said second movable arm when said second movable arm is in it's innermost position.

20. The garment hanger of claim 17 wherein said linkage tongues are further coupled to a transfer mechanism located proximate to said medial portion for reciprocal adjustment of said movable arms.

21. The garment hanger of claim 20 wherein said transfer mechanism comprises of a first gear coupled to said first linkage tongue; a second gear coupled to said second linkage tongue and at least a third gear linking between said first gear and said second gear.

* * * * *